US005716509A

United States Patent [19]

Kamm

[11] Patent Number: 5,716,509

[45] Date of Patent: Feb. 10, 1998

[54] PROCESS AND DEVICE FOR THE ELECTROLYTIC SURFACE COATING OF WORKPIECES

[75] Inventor: Rudolf Kamm, Weesen, Switzerland

[73] Assignee: Ecograph AG, Weesen, Switzerland

[21] Appl. No.: 532,771

[22] PCT Filed: Feb. 15, 1994

[86] PCT No.: PCT/CH94/00031

§ 371 Date: Sep. 28, 1995

§ 102(e) Date: Sep. 28, 1995

[87] PCT Pub. No.: WO95/21952

PCT Pub. Date: Aug. 17, 1995

[51] Int. Cl.[6] ..... C25D 5/00; C25D 17/00; C25D 21/06; C25D 21/10

[52] U.S. Cl. ..... 205/99; 205/101; 205/134; 205/137; 204/212; 204/237; 204/238; 204/273; 204/276; 204/232; 204/240

[58] Field of Search ..... 205/148, 98–99, 205/100, 101, 137–138, 143, 219, 133–134; 204/237, 238, 273, 232, 240, 212, 133–134, 276

[56] References Cited

U.S. PATENT DOCUMENTS

| | | | |
|---|---|---|---|
| 1,417,464 | 5/1922 | Edison | 204/238 X |
| 3,450,625 | 6/1969 | Ramsey et al. | 204/237 |
| 3,860,508 | 1/1975 | Durin | 205/101 X |
| 4,160,709 | 7/1979 | Tuscher et al. | 204/237 X |
| 5,346,607 | 9/1994 | Swanson et al. | 205/99 |
| 5,391,285 | 2/1995 | Lytle et al. | 204/238 X |
| 5,514,258 | 5/1996 | Brinket et al. | 204/237 |

FOREIGN PATENT DOCUMENTS

| | | |
|---|---|---|
| A0196420 | 10/1986 | European Pat. Off. . |
| A0387750 | 9/1990 | European Pat. Off. . |
| A3429890 | 2/1986 | Germany . |
| A1562589 | 3/1980 | United Kingdom . |
| A2097427 | 11/1982 | United Kingdom . |

*Primary Examiner*—Donald R. Valentine
*Attorney, Agent, or Firm*—Ladas & Parry

[57] ABSTRACT

A process and apparatus for electrolytically surface-coating special metal workpieces in which the electrolyte is conveyed in a controlled circuit in and around the electrolysis region in that most of it is conveyed at a high flow rate, at a higher inlet pressure, through the space between a cathodically connected workpiece and an anode and a smaller proportion of it is conveyed at a lower flow rate upwards to the rear of the anode away from the cathode. After leaving the electrolysis region the electrolyte is taken into a separate overflow tank and/or in the feed back system. The device for implementing said process is an electrolysis tank, inlet lines or apertures for the electrolyte at the base of the chamber between the cathodically connected workpiece and the anode or below and behind the anode, at least one overflow tank connected on or beneath the electrolysis container into which the electrolyte is fed after passing through the electrolysis region and a feed back device for the electrolyte with a filter.

36 Claims, 2 Drawing Sheets

PROCESS AND DEVICE FOR THE ELECTROLYTIC SURFACE COATING OF WORKPIECES

Figure 1:
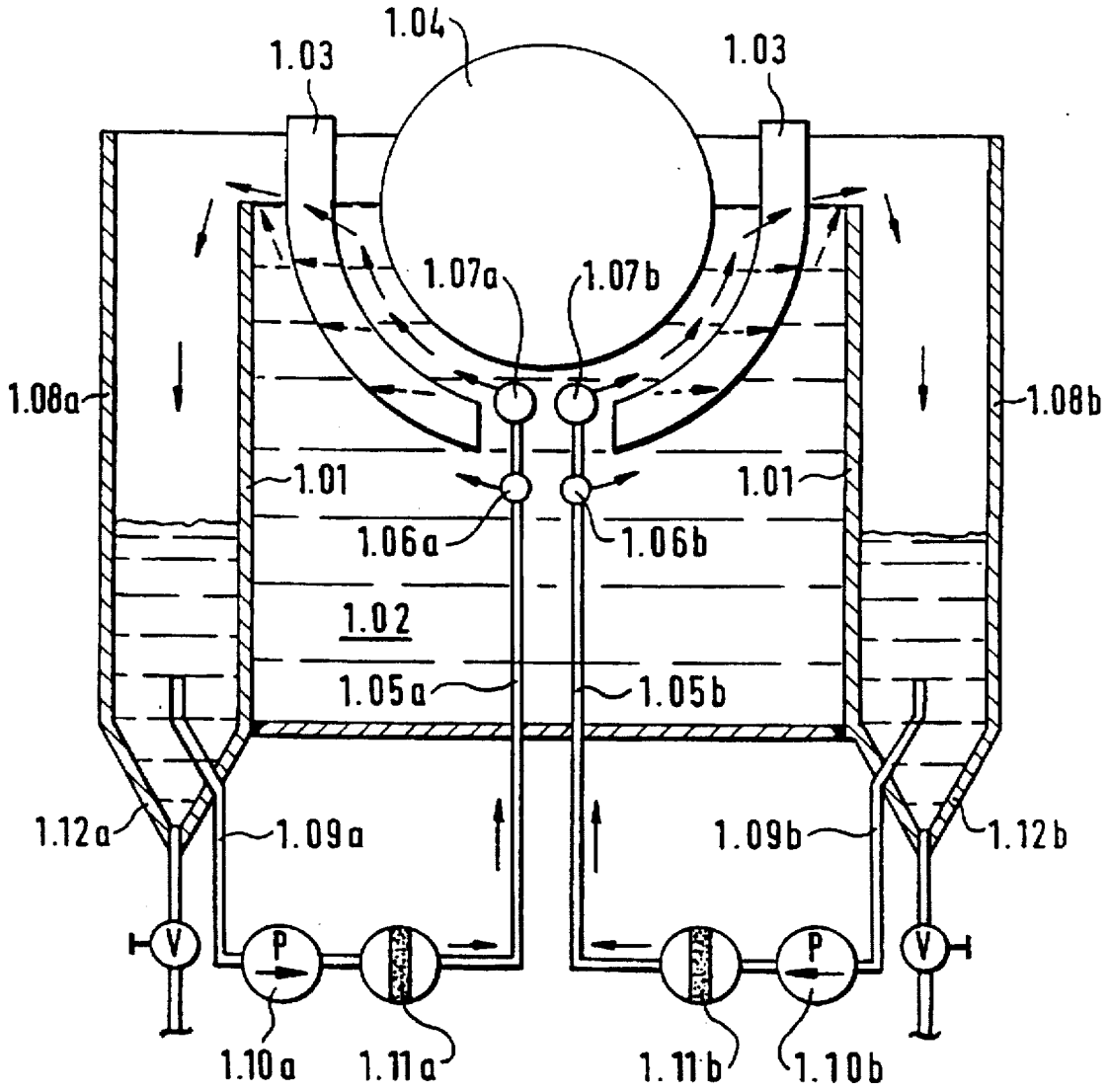

The invention described here concerns a process as well as a device for electrolytic surface coating of electrically conductive objects, in particular of metal workpieces, as well as a special application of said device.

Electrolytic surface coatings of metal objects have for a long time constituted part of the prior art; said technology is widely represented in the patent literature.

Recent, pertinent, published patent applications include EP-A 0 196 420, EP-A 0 387 750 as well as DE-A 34 29 890.

In EP-A 0 196 420 (publication date Oct. 8, 1986), a high-speed electrolysis cell for surface coating of strip product is taught. Said device includes a vertical electrolytic galvanization cell for the coating of steel strips, in which the strip is guided by an upper guide roller or flow roller to a lower guiding immersion roller and from there to an additional, upper guide roller or flow roller. In this process, the falling and rising section of the strip to be coated is bombarded in a gap between vertically disposed anodes by the electrolyte stream guided in the circuit at a high speed counter to the direction the strip is moving. In such an electrolysis cell, the circulation of greater amounts of electrolyte is obtained using the least possible pumping energy.

According to EP-A 0 387 750 (publication date Sep. 19, 1990), the electrolysis cell described therein is characterized by a plurality of current feeds and a plurality of electrolyte inlets or discharges. By means thereof, uniform electrolysis and coating are achieved.

And finally, the arrangement from DE-A 34 29 890 is used for the application of a copper layer on an intaglio cylinder in a galvanization bath, which has a copper-containing electrolyte and at least one anode made of copper. The anode may have the form of a plate provided with a plurality of perforations, specifically that of a perforated metal plate or metal mesh concentrically disposed around the printing cylinder. This arrangement enables the performance of the electrolysis with relatively low voltage and application of a uniform copper layer on the cathodically connected intaglio cylinder.

A common element of the three teachings mentioned is that they do not pay adequate attention to the design-based elimination of the anode sludge. The accomplishment of this object leads, however, as tests of the applicant have clearly shown, to a significantly improved quality of the electrically applied coating layer in terms of homogeneity, i.e., a homogenous, fine-crystalline microstructure as well as corrosion resistance.

The process according to the invention for electrolytic surface coating of the electrically conductive workpieces, in particular of metal workpieces, by means of a fluid electrolyte is characterized in that the electrolyte is conveyed in a controlled circuit into and around the electrolysis region between the anode and the cathodically connected workpiece, whereby most of the electrolyte is conveyed at a high flow rate, possibly at a higher inlet pressure, through the space between the cathodically connected workpiece and the anode, and a smaller share thereof is conveyed at a lower flow rate upward to the rear of the anode away from the cathode, that the electrolyte is taken into a separate overflow tank after leaving the electrolysis region, and that the electrolyte is fed back from the overflow tank into and around the electrolysis region between the anode and cathode, whereby in the overflow tank and/or in the feedback device, anode sludge is precipitated or separated from the electrolyte.

In the process mentioned, it is further relevant that the electrolyte is conveyed to the anode, passed through the anode, or removed by the anode, that most of the anode sludge formed during the electrolysis is removed from the flowing electrolyte.

Advantageously, the electrolyte is continuously monitored in the circuit with regard to the essential process parameters such as temperature, conversion, content, etc. and optimized, if need be.

During the process the cathodically connected workpiece is either stationary or is moved during the electrolytic surface coating, in particular rotated; the anode is either periodically replaced or the anode material is continuously added.

As mentioned, during this circuit through the overflow tank the anode sludge is separated or precipitated either by means of settling and/or by means of electrodes, and/or the sludge particles are retained on a filter included in the feedback device.

The arrangement according to the invention for electrolytic surface coating of the electrically conductive workpieces, in particular metal workpieces, by means of a fluid electrolyte is characterized by an electrolysis tank in which the surface coating of the cathodically connected workpiece and the release of the coating material from the anode or from the electrolyte occur, by inlet lines or apertures for the electrolyte at the base in the space between the cathodically connected workpiece and the anode or at the base behind the anode, by at least one overflow tank connected to or under the electrolysis tank in which the electrolyte arrives after flowing through the electrolysis region, and by a reconveying device with a filter, which enables the circulation of the electrolyte and its cleaning of anode sludge as well as its supply to or through the anodes technically adequately controlled with regard to amount, direction, and speed, Especially suitable for this are the inlet lines or apertures for the electrolyte in the anode region, which are variable and optimizable in their number, disposition, and flow rate.

Thus, either the bottom of the overflow tank is designed as a settling cone with an evacuation device—which settling cone may also have baffles and/or precipitation electrodes to improve the degree of precipitation—and/or a filter is provided in the line of the feedback device upstream in the flow direction before the conveying unit, which is continuously or periodically cleaned.

In the device specified above the cathodically connected object may be either stationary or movable, in particular rotatable, partially or completely immersed in the electrolyte contained in the electrolysis tank, and the anode or the anode sections—likewise in the electrolyte—may be immersed and optimally disposed with regard to their position relative to the cathodically connected object.

The cathodically connected object may be a printing cylinder for intaglio printing which is held partially immersed in the electrolyte and is stationarily or rotatably disposed; the anode sections are then disposed in the shape of dishes and at a short distance from the printing cylinder, whereby the sections may be porous or perforated. The inlet lines or apertures for the electrolyte into the electrolysis region are capable of permitting technically adequate precisely controlled supply of the electrolyte into said region in terms of amount, distribution, direction, and speed.

Devices for control and optimization of the major parameters of the electrolyte such as flow rate, temperature, concentrations, etc. are also important for this.

The device according to the invention is used primarily for fabrication of intaglio cylinders with a material structure of the surface coating free of foreign bodies (especially of sludge) and consequently fine crystalline, homogeneous, and also corrosion resistant.

In the following both the device according to the invention and the process implemented therewith are now illustrated by way of example and in detail with reference to the two drawings associated with the description of the invention.

They depict

FIG. 1 a schematic representation of a device according to the invention with the overflow tank connected to the electrolysis tank, and FIG. 2 an analogous representation of such a device with the overflow tank disposed below the electrolysis tank.

In the device according to FIG. 1, the electrolysis tank 1.01 with the electrolyte bath 1.02 is disposed centrally; of course, the actual dimensions of this tank correspond to those of the workpiece to be coated. The anode or the anode sections 1.03 are installed corresponding to the cathodically connected workpiece 1.04. By means of the two inlet lines 1.05*a*, 1.05*b*, the electrolyte is delivered to the corresponding discharge apertures 1.06*a*, 1.06*b* and 1.07*a*, 1.07*b*. The two discharge apertures 1.07*a* and 1.07*b* are designed and installed such that most of the electrolyte conveyed arrives at the base in the space between the anode sections 1.03 and the cathodically connected workpiece 1.04 and flows upward from there between the electrodes and partially through the anode sections: This is indicated by the arrows in the figure. A smaller share of the electrolyte emerges at the apertures 1.06*a*, 1.06 [sic 1.06*b*] into the electrolyte bath and moves upward from there on the side of the anode turned away from the cathode. These two guided streams effect optimal removal and adequately reliable evacuation of most of the anode sludge formed upon dissolution of the anode.

Along with the circulating electrolyte, the anode sludge passes from the electrolysis tank into the overflow tanks 1.08*a*, 1.08*b* disposed near said tank. Thus, if the electrolysis tank 1.02 is a relatively long vat, the two connected overflow tanks 1.08*a* and 1.08*b* are narrow side vats. From the overflow tanks 1.08, 1.08*b*, the fluid electrolyte runs through the lines 1.09*a*, 1.09*b* to the conveying units 1.10*a*, 1.10*b*, which feed the medium through the filters 1.11*a*, 1.11*b* back through the lines 1.05*a*, 1.05*b* to the discharge apertures described further above.

The two overflow tanks 1.08*a*, 1.08*b* (collectively, they may form a circulating, closed receiving tank) may have independent or a connected settling cone 1.12*a*, 1.12*b* with a corresponding evacuation line.

Figure 2:
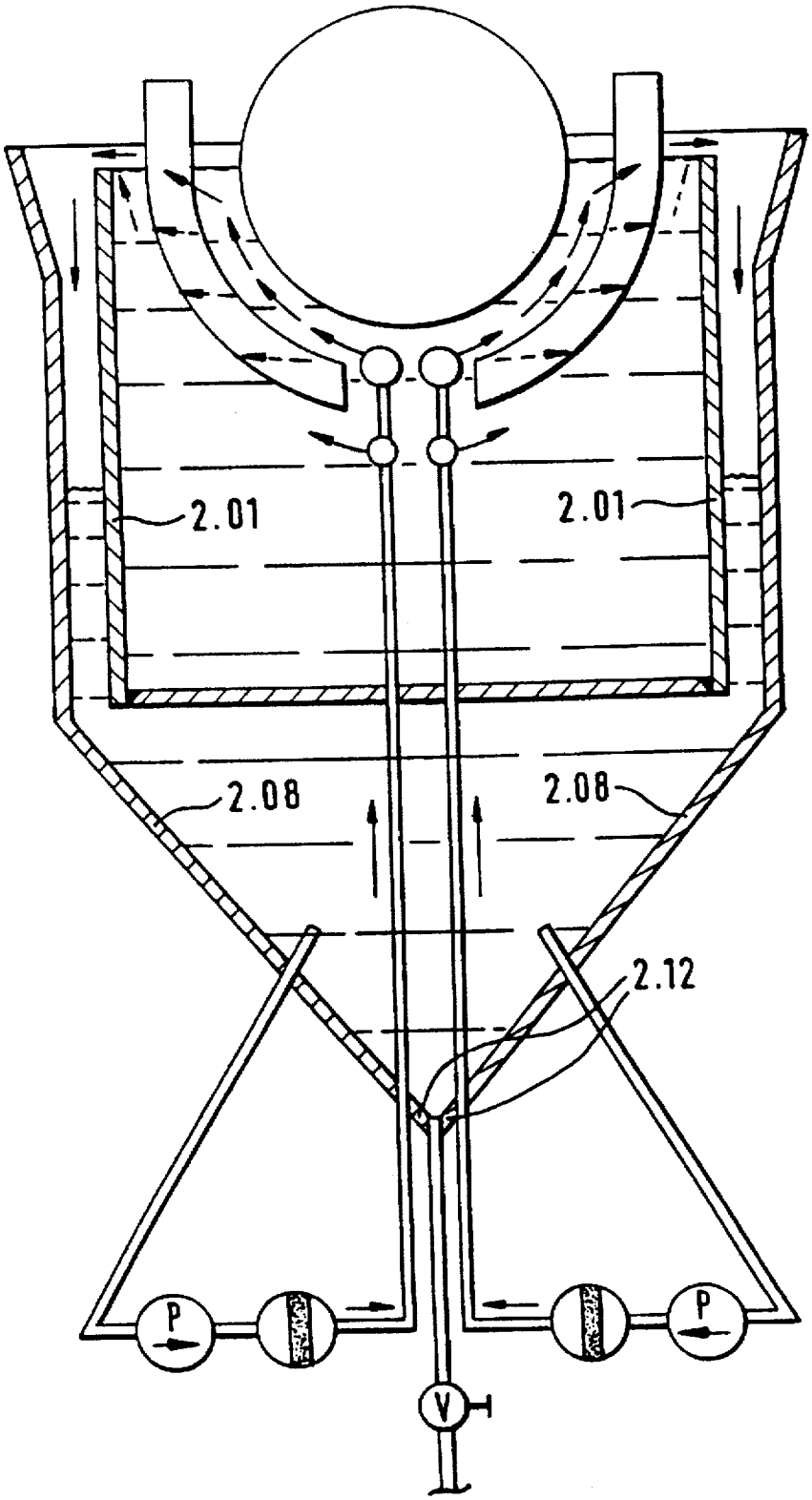

FIG. 2 depicts the corresponding device with the overflow tank 2.08 disposed below the electrolysis tank 2.01. The overflow tank also has a settling cylinder 2.12 with an evacuation line.

In the two figures, the auxiliary devices for control and optimization of the operating parameters for the electrolyte are not shown.

Only through the active removal of the anode sludge at its point of origin and the passive settling thereof out of the electrolyte circuit is the effect to be obtained according to the invention fully achieved. For the person skilled in the art it is clear that the practical means reported in these examples for the active and passive removal of anode sludge may be replaced by other elements with similar action.

I claim:

1. A process for electrolytic surface coating of an electrically conductive workpiece by means of a fluid electrolyte, the process comprising:

conveying the electrolyte in a controlled circuit into an fluid electrolyte, the process comprising:

conveying the electrolyte in a controlled circuit into an electrolysis tank and into and around an electrolysis region in the electrolysis tank, the electrolysis region being defined by an anode and a cathodically connected workpiece, the electrolysis tank having an overflow region through which electrolyte can flow from the electrolysis region and into an overflow tank, the anode having a first side closest to the workpiece and a second side farthest from the workpiece, a greater portion of the electrolyte being conveyed in a first stream from a first inlet at a higher flow rate into a space between the cathodically connected workpiece and the anode, the first stream flowing adjacent to and generally parallel to the first side of the anode and flowing toward and into the overflow region, a lesser proportion of the electrolyte being conveyed in a second stream from a second inlet at a lower flow rate, the second stream flowing adjacent to and generally parallel to the second side of the anode and flowing toward and into the overflow region;

removing the electrolyte into the overflow tank once the electrolyte has passed through the electrolysis region and the overflow region;

separating anode sludge from the electrolyte in the overflow tank; and feeding the electrolyte back from the overflow tank into and around the electrolysis region.

2. The process as claimed in claim 1 wherein the electrolyte is conveyed with respect to the anode such that a substantial proportion of the anode sludge formed during electrolysis is removed from the flowing electrolyte to the overflow tank.

3. The process as claimed in claim 1 wherein the temperature, conversion and contents of the electrolyte are continuously controlled during circulation of the electrolyte.

4. The process as claimed in claim 1 wherein the cathodically connected workpiece is stationary during the electrolytic surface coating.

5. The process as claimed in claim 1 wherein the cathodically connected workpiece is moved during the electrolytic surface coating thereof.

6. The process as claimed in claim 1 wherein the workpiece has a surface submerged in the electrolyte and the first stream flows generally parallel to the surface of the workpiece.

7. The process as claimed in claim 1 wherein, during circulation of the electrolyte through the overflow tank, the anode sludge is separated or precipitated from the electrolyte by means of settling.

8. The process as claimed in claim 1 wherein, during circulation of the electrolyte through the overflow tank, the anode sludge is separated from the electrolyte by means of settling and sludge particles are retained on a filter.

9. The process as claimed in claim 1 wherein the electrically conductive workpiece is a metal intaglio cylinder.

10. The process as claimed in claim 1 wherein the first stream is introduced into the electrolysis region at a high inlet pressure.

11. The process as claimed in claim 13 wherein the anode sludge is separated from the electrolyte by precipitation.

12. A process as claimed in claim 1 wherein the side of the anode closest to the workpiece and the side, of the anode farthest from the workpiece are the two largest sides of the anode.

13. A process for electrolytic surface coating of an electrically conductive workpiece by means of a fluid electrolyte, the process comprising:

conveying the electrolyte in a controlled circuit into and around an electrolysis region defined by an anode and a cathodically connected workpiece, a greater portion of the electrolyte being conveyed at a high flow rate into a space between the cathodically connected workpiece and the anode, and a lesser proportion of the electrolyte be conveyed at a lower flow rate at a side of the anode away from the workpiece, the cathodically connected workpiece being moved by rotation thereof during the electrolytic surface coating;

removing the electrolyte into a separate overflow tank once the electrolyte has passed through the electrolysis region;

separating anode sludge from the electrolyte in the overflow tank; and feeding the electrolyte back from the overflow tank into and around the electrolysis region.

14. A process for electrolytic surface coating of an electrically conductive workpiece by means of a fluid electrolyte, the process comprising:

conveying the electrolyte in a controlled circuit into and around an electrolysis region defined by an anode and a cathodically connected workpiece, a greater portion of the electrolyte being conveyed at a high flow rate into a space between the cathodically connected workpiece and the anode, and a lesser proportion of the electrolyte be conveyed at a lower flow rate at a side of the anode away from the workpiece;

removing the electrolyte into a separate overflow tank once the electrolyte has passed through the electrolysis region;

separating anode sludge from the electrolyte in the overflow tank; and feeding the electrolyte back from the overflow tank into and around the electrolysis region;

wherein anode material is continuously added.

15. A process for electrolytic surface coating of an electrically conductive workpiece by means of a fluid electrolyte, the process comprising:

conveying the electrolyte in a controlled circuit into and around an electrolysis region defined by an anode and a cathodically connected workpiece, a greater portion of the electrolyte being conveyed at a high flow rate into a space between the cathodically connected workpiece and the anode, and a lesser proportion of the electrolyte be conveyed at a lower flow rate at a side of the anode away from the workpiece;

removing the electrolyte into a separate overflow tank once the electrolyte has passed through the electrolysis region;

separating or precipitating anode sludge from the electrolyte in the overflow tank by means of electrodes; and feeding the electrolyte back from the overflow tank into and around the electrolysis region.

16. An apparatus for electrolytic surface coating of an electrically conductive workpiece by means of a fluid electrolyte, the apparatus comprising:

means for connecting the workpiece to a cathode;

an electrolysis tank wherein release of a coating material from an anode or an electrolyte occurs and wherein at least a portion of the workpiece is positioned for surface coating so that a first side of the anode is closest to the workpiece and a second side of the anode is farthest from the workpiece, the electrolysis tank having an overflow region;

a first and second inlet means for introducing the electrolyte into an electrolysis region in the electrolysis tank, the electrolysis region being defined as a space about the workpiece and the anode, the first inlet means producing at a higher flow rate a first stream flowing adjacent to and generally parallel to the first side of the anode and flowing toward and into the overflow region, the second inlet means producing at a lower flow rate a second stream flowing adjacent to and generally parallel to the second side of the anode and flowing toward and into the overflow region;

at least one overflow tank in communication with the electrolysis tank into which the electrolyte is conveyed after flowing through the electrolysis region and the overflow region; and a feedback device for circulating the electrolyte between the overflow tank and electrolysis tank, the feedback device including control means for controlling the amount, direction and speed of the electrolyte.

17. The apparatus as claimed in claim 16 wherein the inlet means comprises inlet lines and apertures, the inlet lines and apertures being positioned within the electrolysis tank.

18. The apparatus as claimed in claim 17 wherein the inlet lines and apertures for the electrolyte are variable in size, number, disposition and flow rate.

19. The apparatus as claimed in claim 16 wherein the feedback device includes a filter to facilitate cleaning of anode sludge.

20. An apparatus as claimed in claim 16 wherein the apparatus is adapted for submersing a surface of the workpiece in the electrolyte and the apparatus is adapted for enabling the first stream to flow generally parallel to the submerged surface of the workpiece when the workpiece is present.

21. An apparatus as claimed in claim 16 wherein the first side of the anode and the second side of the anode are the two largest sides of the anode.

22. An apparatus for electrolytic surface coating of an electrically conductive workpiece by means of a fluid electrolyte, the apparatus comprising:

means for connecting the workpiece to a cathode;

an electrolysis tank wherein release of a coating material from an anode or an electrolyte occurs and wherein the surface coating of a cathodically connected workpiece occurs;

inlet means for introducing the electrolyte into an electrolysis region defined as a space about the workpiece and the anode;

at least one overflow tank in communication with the electrolysis tank into which the electrolyte is conveyed after flowing through the electrolysis region, wherein a base of the overflow tank comprises a settling cone; and a feedback device capable of circulating the electrolyte between the overflow tank and electrolysis tank, the feedback device including a control means for controlling the amount, direction and speed of the electrolyte.

23. The apparatus as claimed in claim 22 wherein the settling cone includes baffles to improve precipitation of anode sludge.

24. The apparatus as claimed in claim 22 wherein the settling cone includes precipitation electrodes to improve the degree of precipitation.

25. The apparatus as claimed in claim 22 further comprising a filter in the flow direction upstream of a conveyance unit.

26. The apparatus as claimed in claim 22 wherein the apparatus is adapted for holding the workpiece in a fixed position in the electrolysis tank.

27. The apparatus as claimed in claim 26 wherein the apparatus is adapted for fully immersing the workpiece in the electrolyte when the electrolyte is present.

28. The apparatus as claimed in claim 26 wherein the apparatus is adapted for partially immersing the workpiece in the electrolyte when the electrolyte is present.

29. The apparatus as claimed in claim 26 wherein the anode is adapted for immersion in the electrolyte and for being optimally disposed relative to the workpiece when the workpiece is present.

30. The apparatus as claimed in claim 22 wherein the apparatus is adapted for holding the workpiece in a movable position in the electrolysis tank.

31. The apparatus as claimed in claim 30 wherein the apparatus is adapted for moving the workpiece in a rotatable manner in the electrolysis tank.

32. The apparatus as claimed in claim 22 wherein the workpiece is adapted to be a printing cylinder for intaglio printing, the apparatus being adapted for partially immersing the workpiece in the electrolyte, the anodes being dish-shaped and disposed a short distance from the printing cylinder when present, the anode sections being porous or perforated, and wherein the inlet means for the electrolyte into the electrolysis region is designed to enable precise controlled supply of electrolyte into the electrolysis region and control of the electrolyte with respect to amount, distribution, direction and speed thereof.

33. The apparatus as claimed in claim 22 further including control means for optimization of the electrolyte flow rate, temperature and concentration.

34. A process for electrolytic surface coating of an electrically conductive workpiece by means of a fluid electrolyte, the process comprising:

conveying the electrolyte in a controlled circuit into and around an electrolysis region defined by an anode and a cathodically connected workpiece, a greater portion of the electrolyte being conveyed at a high flow rate into a space between the cathodically connected workpiece and the anode, and a lesser proportion of the electrolyte be conveyed at a lower flow rate at a side of the anode away from the workpiece;

removing the electrolyte into a separate overflow tank once the electrolyte has passed through the electrolysis region, the overflow tank having a base comprising a settling cone;

separating anode sludge from the electrolyte in the overflow tank by allowing the anode sludge to settle in the settling cone; and feeding the electrolyte back from the overflow tank into and around the electrolysis region.

35. An apparatus for electrolytic surface coating of an electrically conductive workpiece by means of a fluid electrolyte, the apparatus comprising:

means for connecting the workpiece to a cathode;

an electrolysis tank wherein release of a coating material from an anode or an electrolyte occurs, wherein the surface coating of the workpiece occurs, and wherein the apparatus is adapted for rotating the workpiece inlet for introducing the electrolyte into an electrolysis region defined as a space about the workpiece and the anode;

at least one overflow tank in communication with the electrolysis tank into which the electrolyte is conveyed after flowing through the electrolysis region; and a feedback device for circulating the electrolyte between the overflow tank and electrolysis tank, the feedback device including a control means for controlling the amount, direction and speed of the electrolyte.

36. A process for electrolytic surface coating of an electrically conductive workpiece by means of a fluid electrolyte, the process comprising:

conveying the electrolyte in a controlled circuit into an electrolysis tank and into and around an electrolysis region in the electrolysis tank, the electrolysis region being defined by an anode and a cathodically connected workpiece, the electrolysis tank having an overflow region through which electrolyte can flow from the electrolysis region and into an overflow tank, the anode having a first side closest to the workpiece and a second side farthest from the workpiece, the electrolyte being conveyed in a first stream from a first inlet into a space between the cathodically connected workpiece and the anode, the first stream flowing adjacent to and generally parallel to the first side of the anode and flowing toward and into the overflow region, the electrolyte being conveyed in a second stream from a second inlet, the second stream flowing adjacent to and generally parallel to the second side of the anode and flowing toward and into the overflow region;

removing the electrolyte into the overflow tank once the electrolyte has passed through the electrolysis region and the overflow region;

separating anode sludge from the electrolyte in the overflow tank; and feeding the electrolyte back from the overflow tank into and around the electrolysis region.

* * * * *